US011633006B2

(12) United States Patent
Pratt et al.

(10) Patent No.: US 11,633,006 B2
(45) **Date of Patent: *Apr. 25, 2023**

(54) RAPID-ENTRY FOOTWEAR HAVING A STABILIZER AND AN ELASTIC ELEMENT

(71) Applicant: FAST IP, LLC, Lindon, UT (US)

(72) Inventors: Michael Pratt, Alpine, UT (US); Craig Cheney, Lindon, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/965,501

(22) Filed: Oct. 13, 2022

(65) Prior Publication Data

US 2023/0031606 A1 Feb. 2, 2023

Related U.S. Application Data

(63) Continuation of application No. 16/942,335, filed on Jul. 29, 2020.

(60) Provisional application No. 62/879,883, filed on Jul. 29, 2019.

(51) Int. Cl.
*A43B 11/00* (2006.01)
*A43B 23/02* (2006.01)

(52) U.S. Cl.
CPC ..... *A43B 11/00* (2013.01); *A43B 23/027* (2013.01)

(58) Field of Classification Search
CPC ..... A43B 11/00; A43B 11/008; A43B 23/027; A43B 23/02; A43B 23/047; A43B 23/08
See application file for complete search history.

(56) References Cited

U.S. PATENT DOCUMENTS

| | | | | |
|---|---|---|---|---|
| 7,685,747 | B1 * | 3/2010 | Gasparovic | A43B 11/00 36/102 |
| 8,769,845 | B2 * | 7/2014 | Lin | A43B 11/02 36/138 |
| 9,820,527 | B2 * | 11/2017 | Pratt | A43B 23/0275 |
| 9,877,542 | B2 * | 1/2018 | Pratt | A43B 3/248 |
| 10,455,898 | B1 * | 10/2019 | Orand | A43C 11/004 |
| 10,568,385 | B2 * | 2/2020 | Beers | A43B 21/28 |
| 10,617,174 | B1 * | 4/2020 | Hopkins | A43B 11/02 |
| 10,638,810 | B1 * | 5/2020 | Cheney | A43B 3/00 |
| 10,743,616 | B2 * | 8/2020 | Beers | A43B 3/248 |
| 10,897,956 | B2 * | 1/2021 | Hopkins | A43B 23/047 |
| 10,905,192 | B1 * | 2/2021 | Cheney | A43B 23/027 |
| 11,000,091 | B1 * | 5/2021 | Kyle | A43B 3/128 |
| 11,064,761 | B2 * | 7/2021 | Cheney | A43B 11/00 |
| 11,191,320 | B2 * | 12/2021 | Happen | A43B 23/0275 |
| 11,191,321 | B2 * | 12/2021 | Kilgore | A43B 11/00 |
| 11,213,098 | B2 * | 1/2022 | Beers | A43B 3/0036 |
| 11,234,482 | B2 * | 2/2022 | Roser | A43C 1/00 |
| 11,344,077 | B2 * | 5/2022 | Hopkins | A43B 23/028 |
| 2004/0111921 | A1 * | 6/2004 | Lenormand | A43B 23/047 36/45 |
| 2012/0180338 | A1 * | 7/2012 | Lin | A43B 9/02 36/56 |
| 2012/0317839 | A1 * | 12/2012 | Pratt | A43B 3/248 36/105 |
| 2017/0303632 | A1 * | 10/2017 | Pratt | A43B 3/248 |
| 2018/0110292 | A1 * | 4/2018 | Beers | A43B 13/28 |

(Continued)

*Primary Examiner* — Bao-Thieu L Nguyen

(57) ABSTRACT

A rapid-entry shoe having an elastic element to enlarge a foot opening of the rapid-entry shoe and also having a stabilizer to prevent a rear portion of the rapid-entry shoe from collapsing downward.

6 Claims, 13 Drawing Sheets

(56) References Cited

U.S. PATENT DOCUMENTS

2018/0289109 A1* 10/2018 Beers ..... A43B 11/00
2018/0295942 A1* 10/2018 Drake ..... A43C 11/008

* cited by examiner

RAPID-ENTRY FOOTWEAR HAVING A STABILIZER AND AN ELASTIC ELEMENT

CROSS-REFERENCE TO RELATED APPLICATION

This application is a continuation of, claims priority to and the benefit of U.S. Ser. No. 16/942,335 filed Jul. 29, 2020 and entitled "RAPID-ENTRY FOOTWEAR HAVING A STABILIZER AND AN ELASTIC ELEMENT." U.S. Ser. No. 16/942,335 claims priority to and the benefit of U.S. Provisional Patent Application No. 62/879,883, filed Jul. 29, 2019 entitled "RAPID-ENTRY FOOTWEAR HAVING AN EXPANDABLE ELASTIC SECTION." All of the aforementioned applications are incorporated herein by reference in their entireties for all purposes.

FIELD

The present disclosure relates to rapid-entry footwear having a stabilizer and an elastic element.

BACKGROUND

Whether due to inconvenience or inability, donning and doffing of shoes, including tying or otherwise securing the same, may be undesirable and/or present difficulties to some individuals. The present disclosure addresses this need.

SUMMARY

Disclosed herein, in various embodiments, is rapid-entry footwear having a stabilizer and/or an elastic element.

In accordance with some embodiments, the rapid-entry shoe comprises a sole portion and an upper, the upper comprising a rear portion, a side portion, a forward portion, and a transition portion between the forward portion and the side portion.

In accordance with some embodiments, the rapid-entry shoe comprises an elastic element disposed at the side portion, the elastic element extending to and forming a portion of a topline of the rapid-entry shoe. In accordance with some embodiments, the rapid-entry shoe comprises an elastic element disposed at the transition portion, not coupled to a tongue of the rapid-entry shoe, and being concave toward or angled relative to the forward portion.

In accordance with some embodiments, expansion or deformation of an elastic element enlarges a foot opening of the rapid-entry shoe, and contraction of an elastic element reduces the foot opening of the rapid-entry shoe. In accordance with some embodiments, an elastic element is configured to enable the forward portion of the rapid-entry shoe to flex and/or pivot forward relative to the sole portion.

In accordance with some embodiments, the rapid-entry shoe further comprises a stabilizer disposed at the rear portion and extending from within the sole portion, the stabilizer comprising a base portion at least partially within the sole portion and an elevated portion.

In accordance with some embodiments, a stabilizer is configured to prevent the rear portion of the rapid-entry shoe from one or more of collapsing downward, flexing rearward and pivoting rearward.

In accordance with some embodiments, a stabilizer comprises a top fin coupled to the elevated portion of the stabilizer, the top fin being configured to be vertically stable and laterally mobile relative to the elevated portion of the stabilizer.

In accordance with some embodiments, a stabilizer comprises an arch structure such that the base portion of the stabilizer comprises a first end and a second end, the first end coupled to or extending from a medial side of the sole portion of the rapid-entry shoe and the second end coupled to or extending from a lateral side of the sole portion of the rapid-entry shoe, the elevated portion of the stabilizer extends between the first end and the second end and around the rear portion of the rapid-entry shoe, and the arch structure of the stabilizer defines a window. Various structures can be incorporated within the window.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
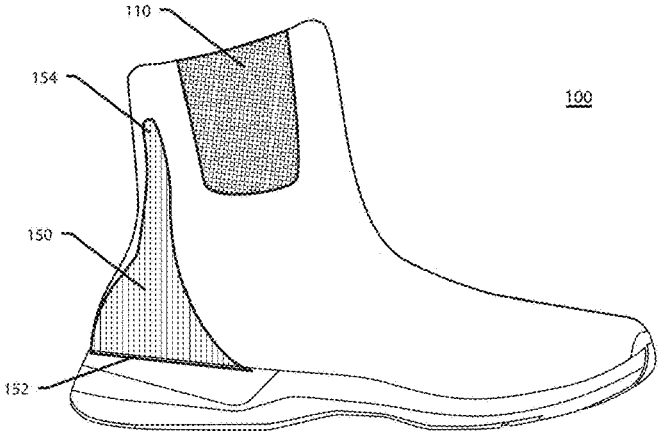
FIG. 1A illustrates a rapid-entry shoe having a stabilizer and an elastic element, in accordance with an example embodiment.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

Although the features of rapid-entry shoes disclosed herein may be implemented in a variety of different types of shoes, the disclosed features may be especially beneficial in connection with boots and/or high-top shoes.

In various embodiments, a rapid-entry shoe comprises a "sole portion" (e.g., footbed, insole, midsole, outsole) and an upper, the upper comprising a "rear portion" (e.g., a heel portion), a medial side portion, a lateral side portion, and a "forward portion" (e.g., a vamp, throat, tongue or nave portion).

In various embodiments, and with reference to FIG. 1A, an upper of a rapid-entry shoe 100 can comprise an elastic element 110 disposed forward relative to a rear portion of the rapid-entry shoe. The elastic element may be an insert, slit, gore or other elongated feature that provides elasticity to the upper. Expansion or deformation of the elastic element 110 can enlarge the foot opening of the rapid-entry shoe 100, while contraction of the elastic element 110 can reduce the foot opening of the rapid-entry shoe 100.

As used herein, the term "foot opening" refers generally to a cross-section of the hole defined by the rapid-entry shoe into which the foot is inserted. That is, the term foot opening does not necessary refer to a top collar/topline opening of the rapid-entry shoe, but may refer to a cross-section of the foot hole of the rapid-entry shoe at various locations within the foot hole of the rapid-entry shoe.

In some embodiments, a strap or mechanical features (e.g., hook and loop fasteners, buttons, clips, grommets, zippers) can secure the elastic element 110 in its contracted configuration.

In some embodiments, the elastic element 110 extends and is coupled to in inner surface of an overlapping portion of the upper. In this regard, expansion or deformation of the elastic element 110 can create visible shearing rather than visible separation, the elastic element 110 possibly being totally obscured by the overlapping portion of the upper in its expanded or deformed configuration.

In some embodiments, the elastic element 110 is not coupled to the tongue of a rapid-entry shoe 100. In other words, in some embodiments, the elastic element 110 is not merely material coupling the tongue to the upper of a rapid-entry shoe 100.

In accordance with example embodiments, the elastic element 110 extends completely or partially to a top collar/topline opening of the rapid-entry shoe 100 (e.g., the elastic element 110 forms a top collar/topline opening). In accordance with example embodiments, the elastic element 110 extends completely or partially to a sole portion of the rapid-entry shoe.

With reference to FIGS. 2A-2D, an elastic element 110 may be embedded within, may extend along (internally or externally), and/or may form a portion of, one or both of the medial side portion of the upper and/or the lateral side portion of the upper. In such embodiments, the elastic element 110 can be disposed at least partially rearward, and/or at least partially upward, relative to a forward portion of the rapid-entry shoe. In example embodiments, the elastic element 110 is angled downward toward the forward portion, while in other embodiments, the elastic element 110 is angled upward toward the forward portion.

Alternatively, and with reference to FIGS. 3A-3D, the elastic element 110, instead of being disposed relative to one or both of the lateral or medial side portion portions of the rapid-entry shoe, may be embedded within, may extend along (internally or externally), and/or may form a portion of, either a forward portion of the rapid-entry shoe or a transition portion of the rapid-entry shoe, the transition portion being disposed between either the lateral or medial side portion of the rapid-entry shoe and the forward portion of the rapid-entry shoe.

In some embodiments, the elastic element 110 can comprise a longitudinal axis that substantially conforms to the shape of the curvature of the forward portion of the rapid-entry shoe 100 (e.g., a longitudinal axis that is concave toward or angled relative to the forward portion). In this regard, the elastic element 110 can be positioned to extend along the curve of the shoe that transitions from the predominantly vertically extending portion of the upper (e.g., the ankle support portion) to the predominantly horizontally extending portion of the upper (e.g., a vamp, throat, tongue or nave portion).

In accordance with example embodiments, the rapid-entry shoe can further comprise a second elastic element. The first elastic element may be disposed on a lateral side portion of the rapid-entry shoe and the second elastic element may be disposed on a medial side portion of the rapid-entry shoe, according to various embodiments.

Figure 4A:
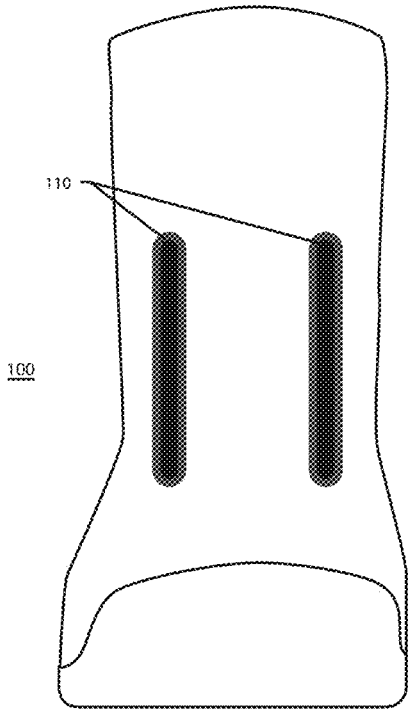
FIGS. 4A-4C are front schematic views of a rapid-entry shoe showing various configurations of elastic elements, in accordance with various embodiments.
Figure 4B:
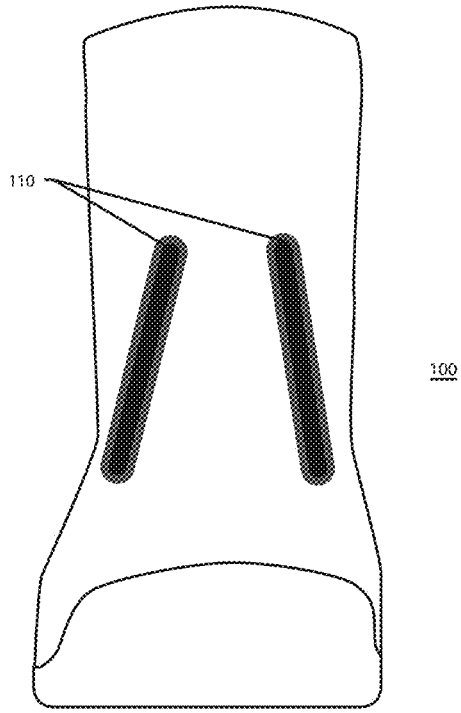
Figure 4C:
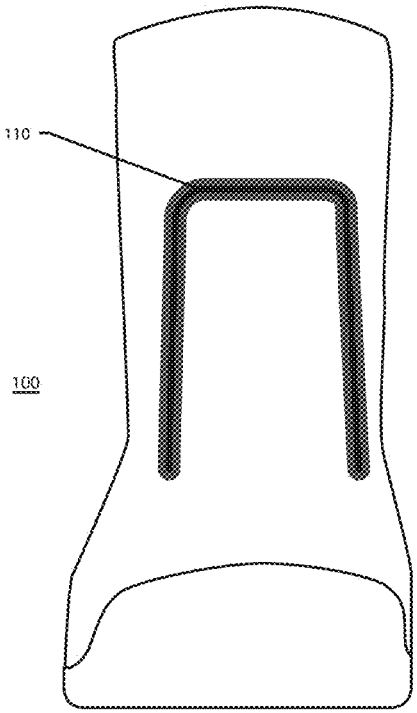
Figure 5A:
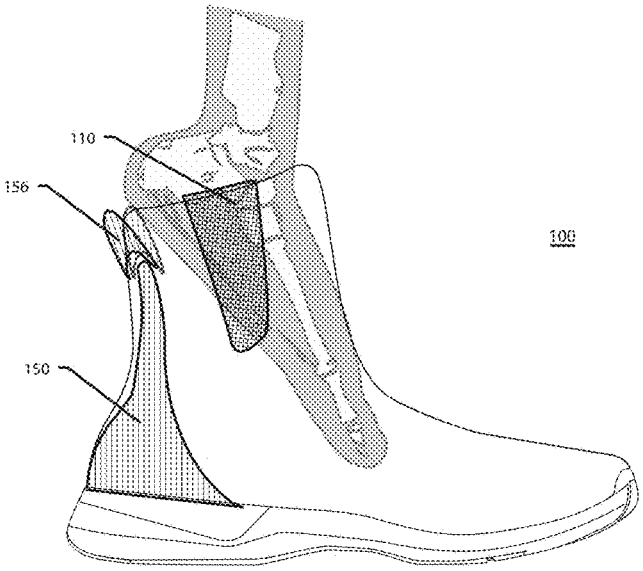
FIGS. 5A-5D illustrate progressive stages of a foot being inserted into a rapid-entry shoe with a stabilizer having a top fin, in accordance with an example embodiment.
Figure 5B:
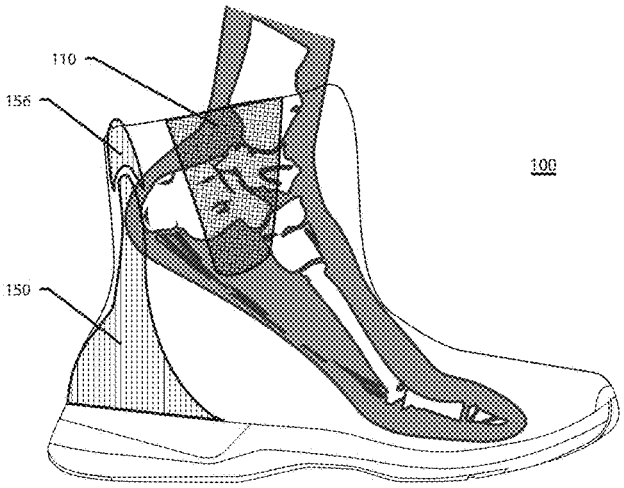
Figure 5C:
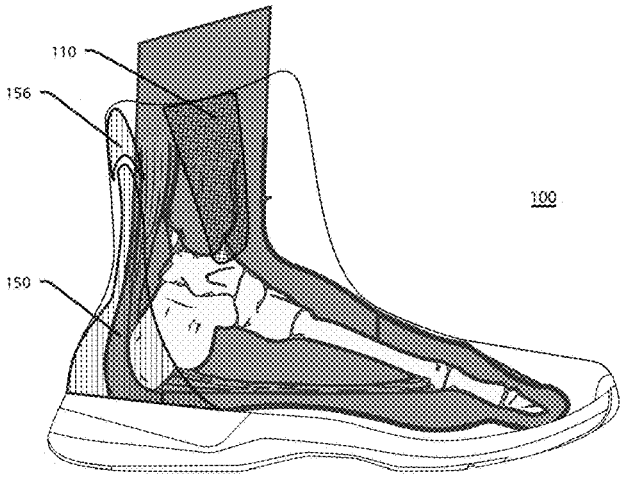
Figure 5D:
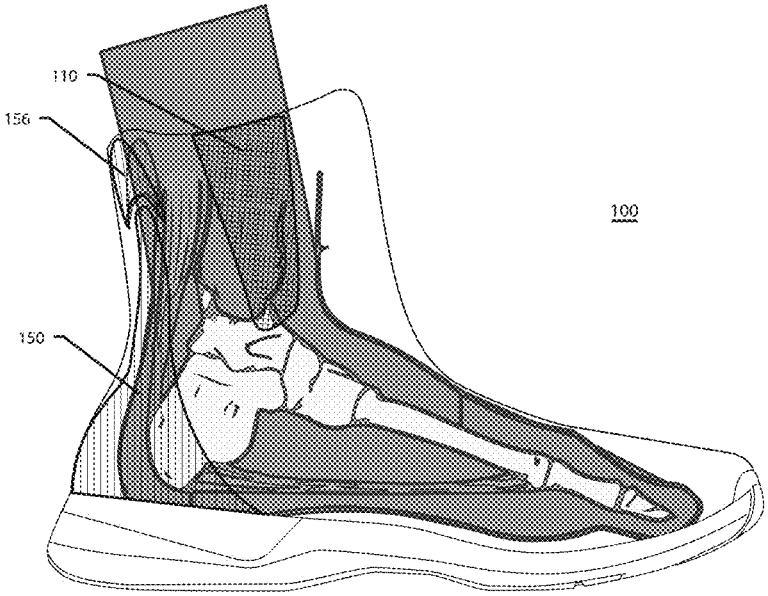

FIGS. 4A-4C are front schematic views of a rapid-entry shoe showing various configurations of first and second elastic elements, in accordance with various embodiments. The elastic elements may extend parallel to each other (FIG. 4A) or may be angled relative to each other (FIG. 4B) (e.g., to conform to the shape of the curvature of the forward portion of the rapid-entry shoe 100). For example, the first elastic element may extend at a first angle relative to a vertical axis that is perpendicular to the footbed of the shoe, and the second elastic element may extend at a second angle relative to the vertical axis. The first and second angle may be different. In various embodiments, the first and second elastic elements include a connecting piece that extends between the elastic elements, and thus extends across a forward portion of the rapid-entry shoe (FIG. 4C).

The elastic element can be comprised of an elastic or resiliently deformable material and/or portion of the upper. In various embodiments, an elastic element is configured to bias the rapid-entry shoe toward contraction of the foot opening. That is, the elastic element is configured to expand in a forward direction (expand the foot opening) and to contract in a rearward direction (contract the foot opening). The elastic element 110 can be on outer or inner surface of the upper or integrated within the upper.

In various embodiments, and as mentioned above, the elastic element(s) may have a longitudinal axis, and the expansion of the elastic element 110 may be perpendicular to its longitudinal axis (e.g., 2-way stretch). That is, the material of the elastic element may be configured to expand in a direction transverse to its length in response to a user's foot being inserted into the foot opening (see FIGS. 2C and 3C, which show the elastic element expanded). However, in various embodiments the elastic element may be configured to expand in a direction parallel to its longitudinal axis (e.g., may be an elongation zone of the rapid-entry shoe). In still other embodiments, the expansion of the elastic element 110 may be perpendicular and parallel to its longitudinal axis (e.g., 4-way stretch).

In various embodiments, and with reference back to FIG. 1A, an upper of a rapid-entry shoe 100 can comprise a stabilizer 150 disposed adjacent the rear portion of the rapid-entry shoe and extending above the sole portion of the rapid-entry shoe, the stabilizer 150 configured to prevent downward (i.e., to not) collapse of the rear portion of the rapid-entry shoe (e.g., the stabilizer may be configured to prevent downward and/or inward compression or bending of the rear portion). In this regard, the stabilizer 150 can be comprised of a stiff, rigid or semi-rigid material. The stabilizer 150 may be embedded within, may extend along (internally or externally), and/or may form a portion of the rear portion of the rapid-entry shoe 100.

In example embodiments, when a foot is inserted, the stabilizer 150 is configured to prevent the rear portion of the rapid-entry shoe 100 from one or more of collapsing downward, flexing rearward and pivoting rearward, relative to the sole portion. At the same time, the stabilizer can, in some embodiments, be configured to enable lateral flexing relative to the sole portion. Also at the same time, as discussed above, the elastic element 110 is configured to enable the forward portion of the rapid-entry shoe 100 to flex and/or pivot forward relative to the sole portion.

The stabilizer 150 may include a base portion 152 and an elevated portion 154, the base portion 152 extends into and/or is coupled to the sole portion of the rapid entry-shoe 100 (e.g., between the insole and the strobel or between the midsole and the outsole). In embodiments wherein the stabilizer extends into and/or is coupled to the sole portion, the stabilizer 150 can extend completely between lateral and medial sides of the sole portion (e.g., cup continuously through the sole portion) or terminate on lateral and medial sides of the sole portion.

In accordance with example embodiments, the stabilizer 150 extends completely or partially to a top collar/topline opening of the rapid-entry shoe. The stabilizer 150 can be on outer surface of the upper or integrated within the upper, e.g., the upper providing ornamental, structural or functional (e.g., waterproofing) benefits.

In accordance with example embodiments, the stabilizer 150 extends from rearward to forward relative to the elastic element 110. In accordance with such embodiments, the stabilizer 150 has a cut (e.g., a living hinge as discussed below) in line with the elastic element 110.

In accordance with example embodiments, the stabilizer 150 comprises a curvature extending between its medial side portion and its lateral side portion, the curvature being convex toward the rear portion (i.e., concave toward or angled relative to the forward portion). In example embodiments, the curvature extends all or partially between the base portion 152 and the elevated portion 154. In example embodiments, the curvature extends progressively less around the sides from the base portion 152 toward the elevated portion 154. In example embodiments, the stabilizer 150 further comprises a flare proximal the elevated portion 154, the flare extending rearward and acting as a shoehorn (e.g., to direct a foot into the foot opening during entry).

Figure 1B:
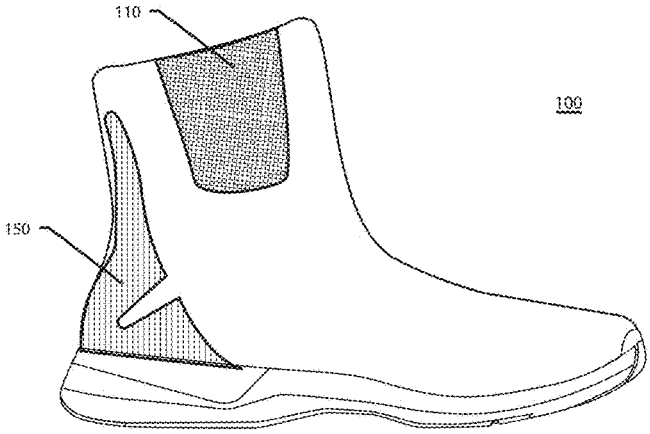
FIG. 1B illustrates a rapid-entry shoe having a pivoting stabilizer, in accordance with an example embodiment.

In accordance with example embodiments, the stabilizer 150 can be configured to flex and/or pivot rearward relative to the sole portion. FIG. 1B illustrates a rapid-entry shoe having a pivoting stabilizer, in accordance with an example embodiment. The pivoting stabilizer may comprise a living hinge, as illustrated.

Figure 1C:
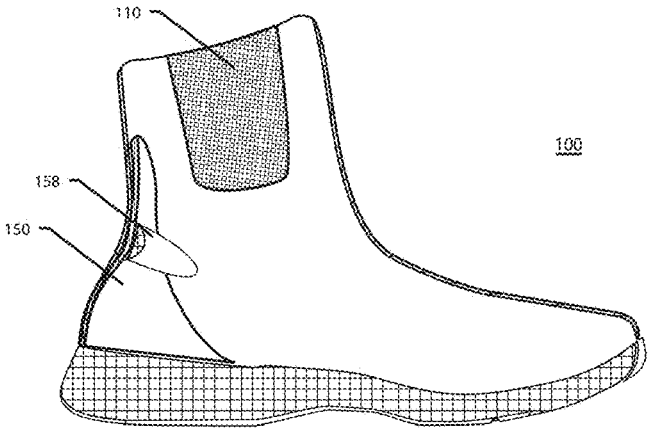
FIG. 1C illustrates a cross-section of a rapid-entry shoe with a stabilizer having a foam liner, in accordance with an example embodiment.
Figure 2A:
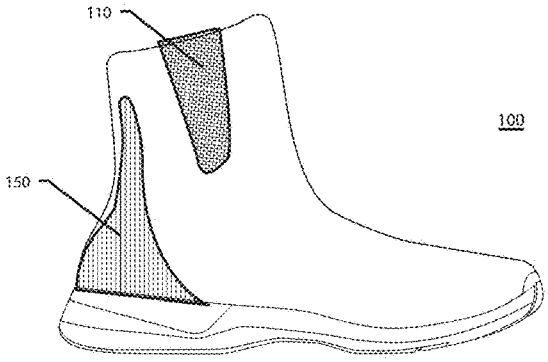
FIGS. 2A-2D illustrate a rapid-entry shoe having an elastic element and progressive stages of a foot being inserted into the rapid-entry shoe, in accordance with an example embodiment.
Figure 2B:
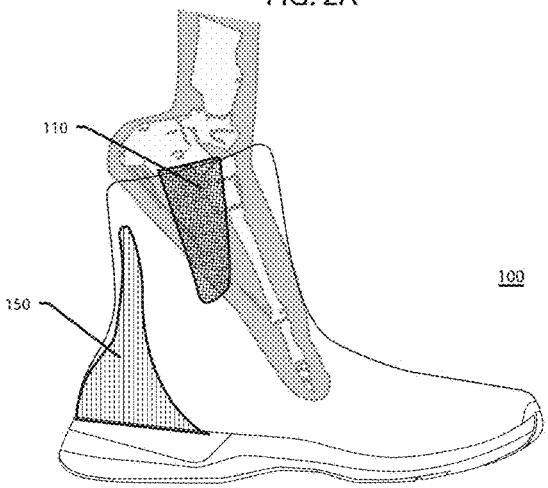
Figure 2C:
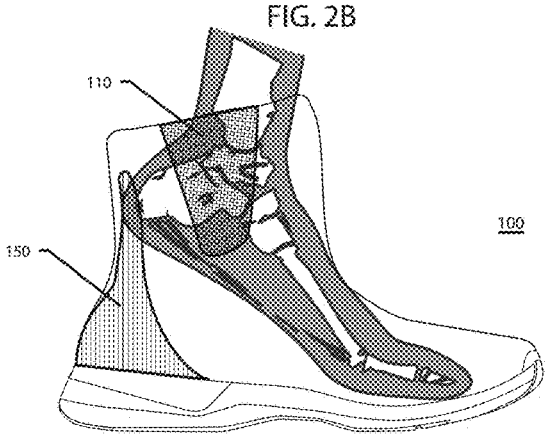
Figure 2D:
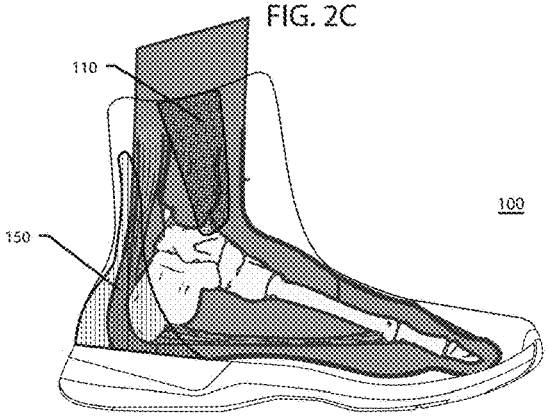
Figure 3A:
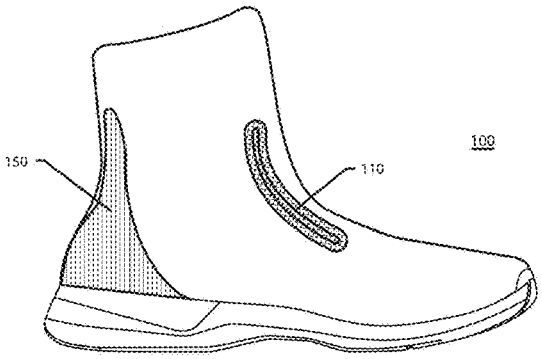
FIGS. 3A-3D illustrate a rapid-entry shoe having an elastic element and progressive stages of a foot being inserted into the rapid-entry shoe, in accordance with another example embodiment.
Figure 3B:
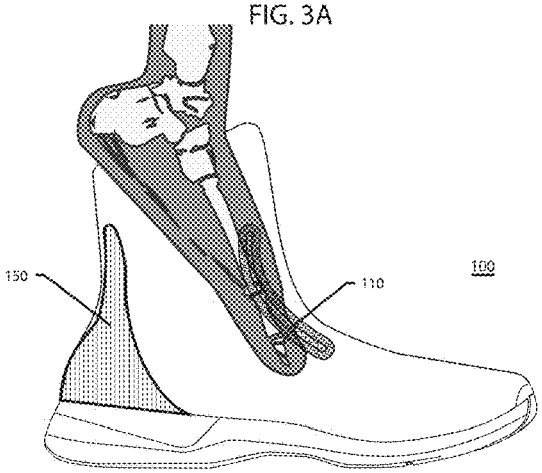
Figure 3C:
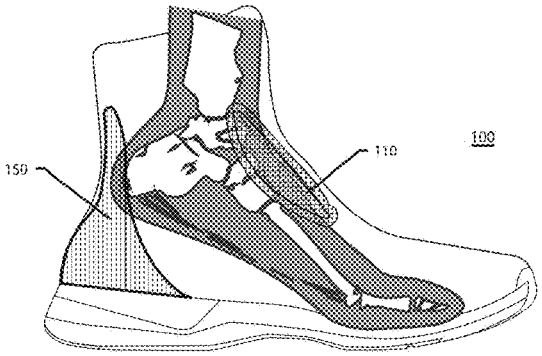
Figure 3D:
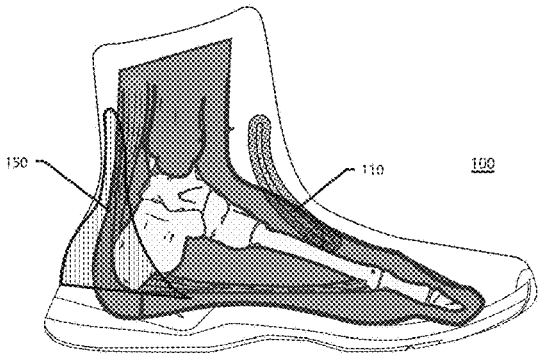

In accordance with example embodiments, the stabilizer 150 can comprise a liner to provide for heel retention and/or comfort. FIG. 1C illustrates a cross-section of a rapid-entry shoe with a stabilizer having a foam liner 158, in accordance with an example embodiment. The foam liner may be configured as a strip that is generally oriented concave toward the sole portion.

In various embodiments, the stabilizer 150 comprises a top fin 156. FIGS. 5A-5D illustrate progressive stages of a foot being inserted into the rapid-entry shoe with a stabilizer having a top fin, in accordance with an example embodiment. The top fin 156 can be comprised of a stiff, rigid or semi-rigid material. The top fin 156 can be configured to be vertically stable (e.g., to direct a foot into the foot opening during entry) and at the same time laterally mobile (e.g., to allow expansion of a top collar/topline opening during entry and comfort when leaning). In this regard, the top fin 156 can be rotatably/deflectably coupled to the stabilizer 150. In various embodiments, the top fin 156 may extend from the stabilizer 150 via a living hinge. That is, the junction between the top fin 156 and the stabilizer 150 may comprise a scored portion or a narrowed portion to enable flexure of the top fin 156 relative to the stabilizer 150.

The top fin 156 can comprise a concave bottom portion configured to receive a convex top portion of the stabilizer 150. Alternatively, the top fin 156 can comprise a convex bottom portion configured to receive a concave top portion of the stabilizer 150.

FIGS. 6A-6K illustrate rapid-entry shoes with elastic elements and stabilizers extending in different directions, in accordance with various embodiments.

Figure 6A:
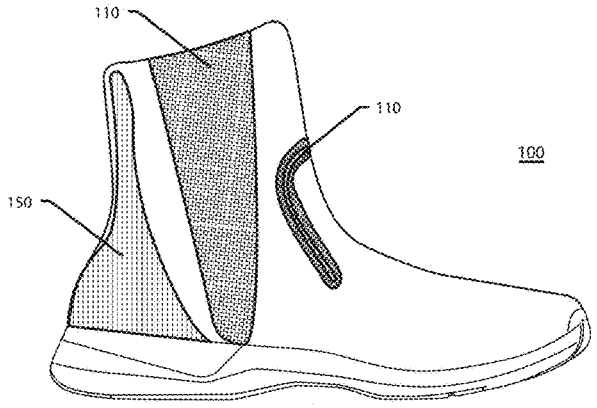
FIGS. 6A-6K illustrate rapid-entry shoes with elastic elements and stabilizers extending in different directions, in accordance with various embodiments.
Figure 6B:
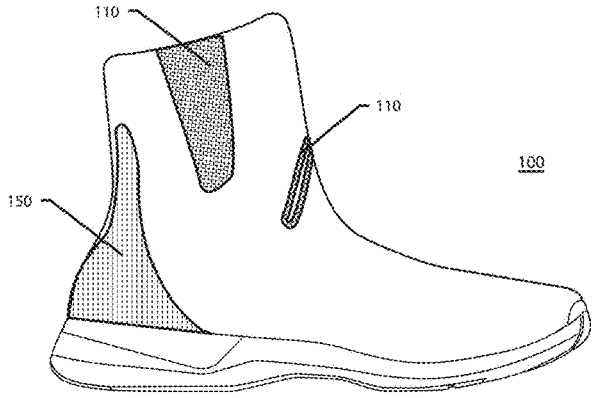
Figure 6C:
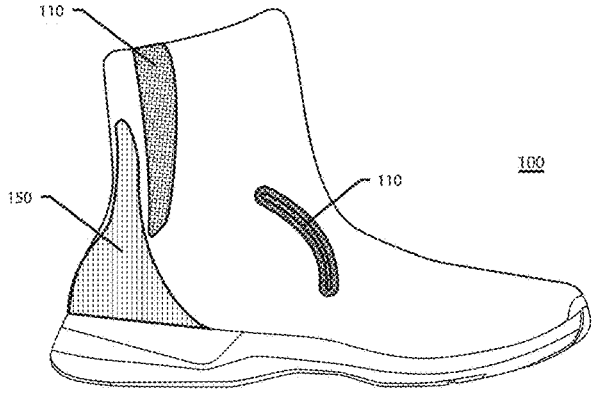
Figure 6D:
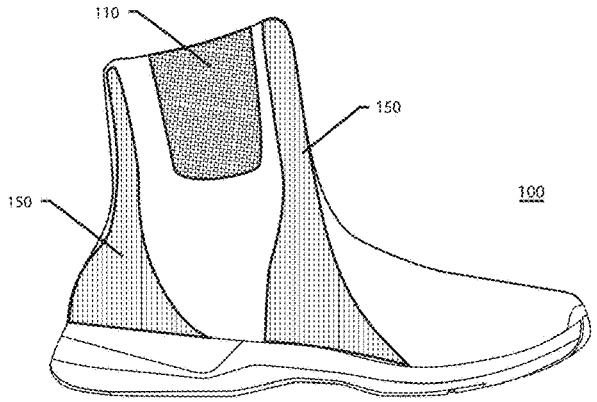
Figure 6E:
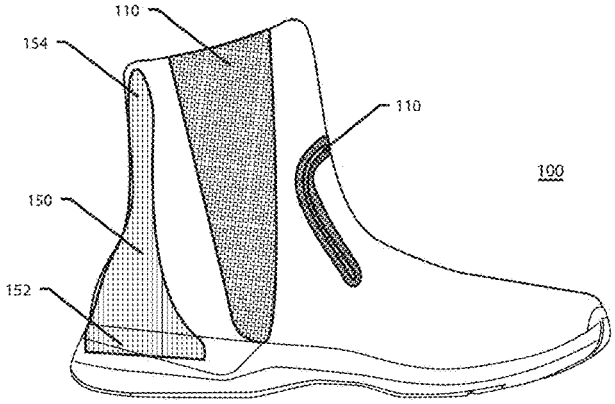
Figure 6F:
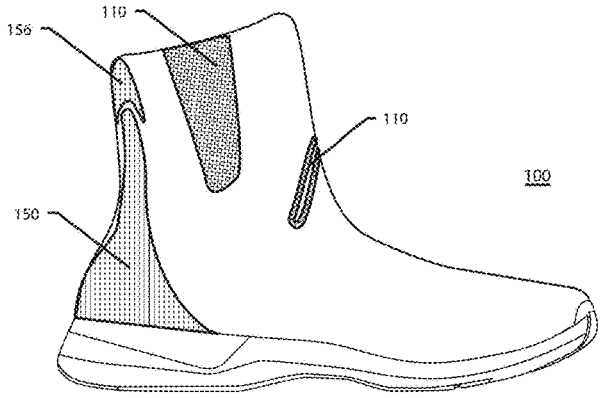
Figure 6G:
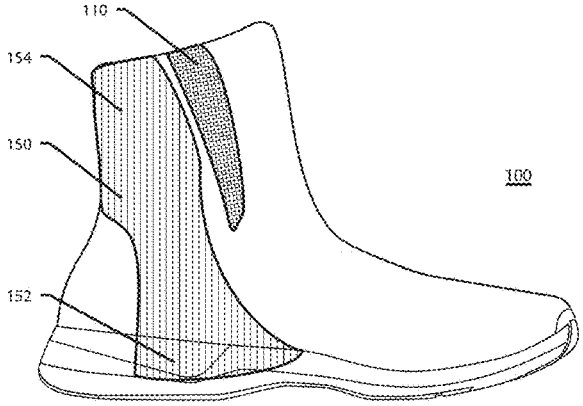
Figure 6H:
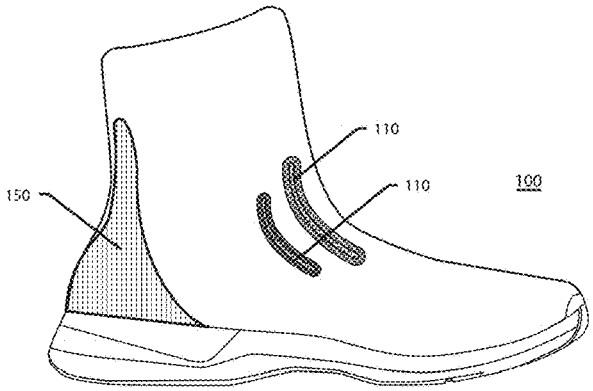
Figure 6I:
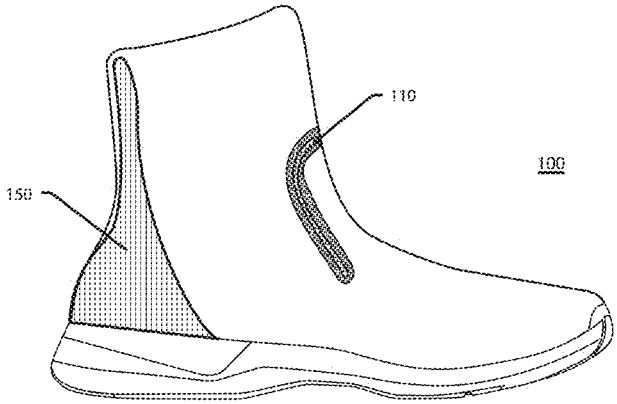

The elastic element 110 can comprise a longitudinal axis that extends lateral, downward and/or rearward from the forward portion (e.g., connected to or integral with an elastic element on the opposite side of the rapid-entry shoe 100 that mirrors the elastic element 110) and curves downward and forward, extending partially toward the sole portion (FIG. 6I).

Figure 6J:
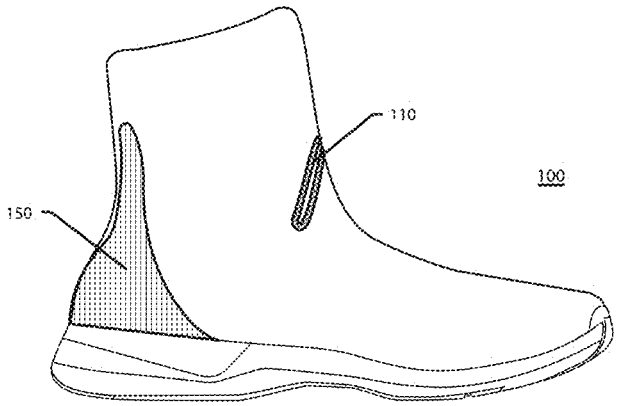

The elastic element 110 can comprise a longitudinal axis that extends lateral, downward and/or rearward from the forward portion (e.g., connected to or integral with an elastic element on the opposite side of the rapid-entry shoe 100 that mirrors the elastic element 110) along a single axis (FIG. 6J).

Figure 6K:
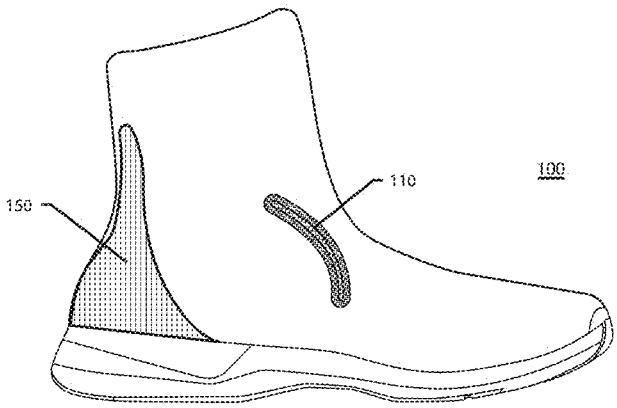
Figure 7A:
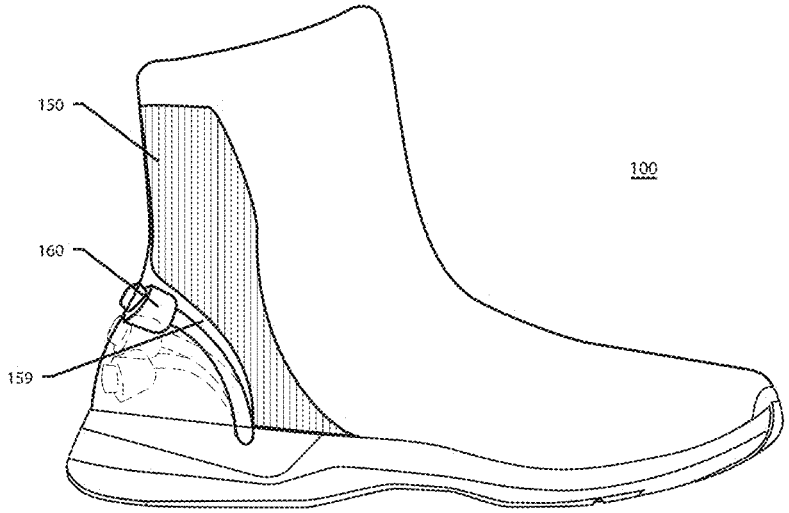
FIG. 7A illustrates a rapid-entry shoe having a resiliently deformable element, in accordance with an example embodiment.
Figure 7B:
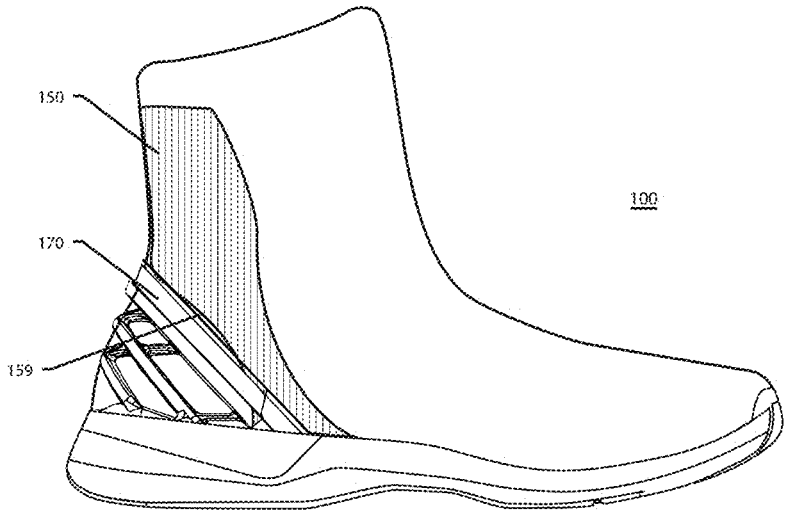
FIG. 7B illustrates a rapid-entry shoe having a compressible lattice structure, in accordance with an example embodiment.
Figure 8A:
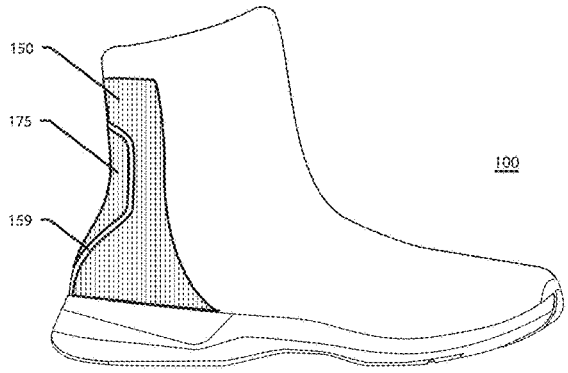
FIGS. 8A-8D illustrate a rapid-entry shoe having an expansion zone and progressive stages of a foot being inserted into the rapid-entry shoe, in accordance with an example embodiment.
Figure 8B:
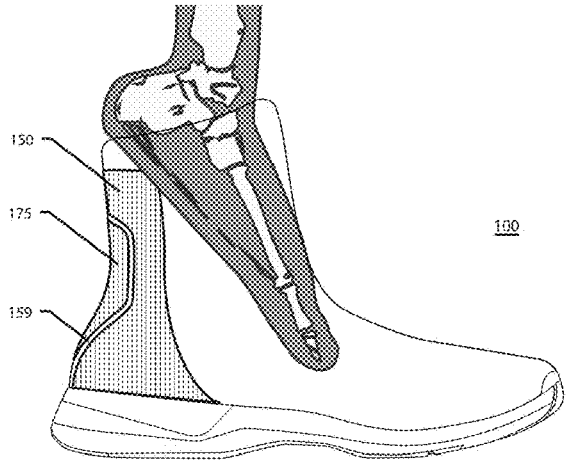
Figure 8C:
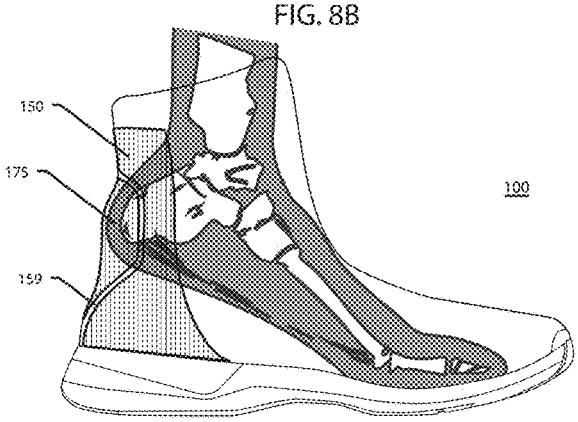
Figure 8D:
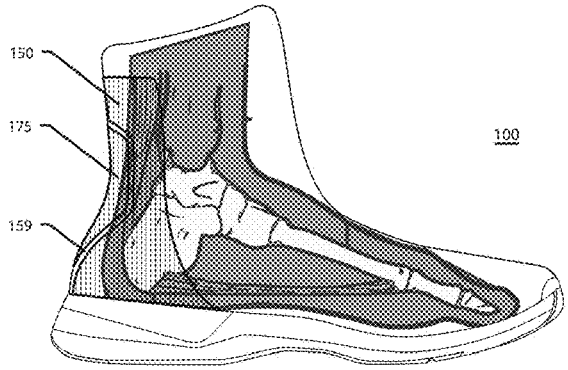
Figure 9A:
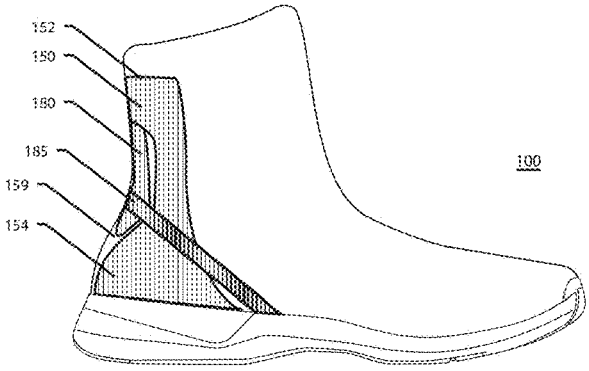
FIGS. 9A-9D illustrate a rapid-entry shoe having a deflectable element and progressive stages of a foot being inserted into the rapid-entry shoe, in accordance with an example embodiment.
Figure 9B:
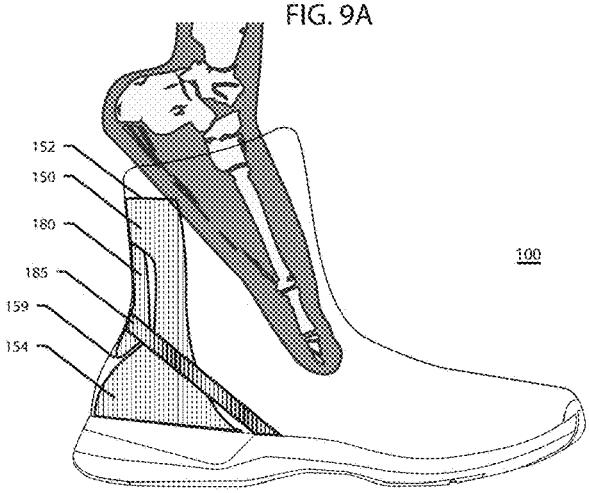
Figure 9C:
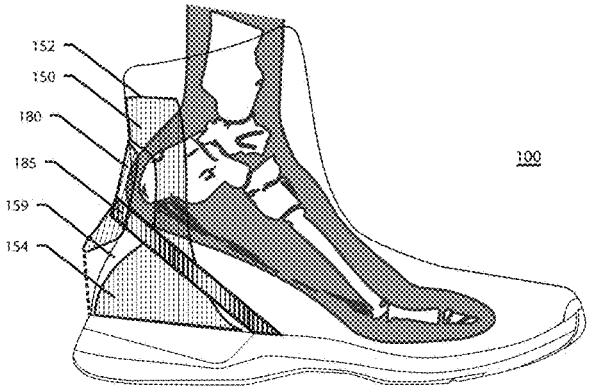
Figure 9D:
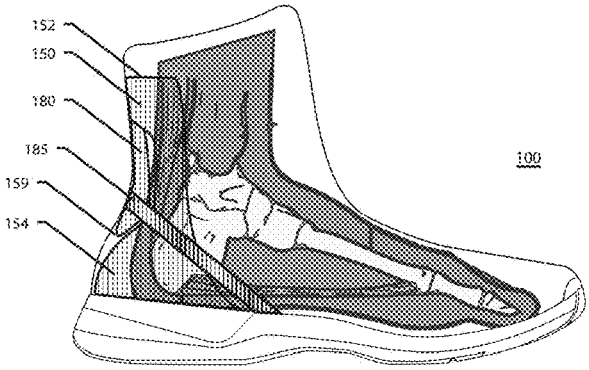

As shown in FIG. 6K, each of the elastic elements 110 can comprise a longitudinal axis that substantially mirrors the shape of the curvature of the forward portion of the rapid-entry shoe 100. That is, the elastic element 110, instead of following the shape of the curvature of the forward portion of the rapid-entry shoe 100, may have a downward and/or rear facing concavity. Said differently, a center of curvature of the elastic element 110 may be toward the sole portion and/or toward the rear portion of the rapid-entry shoe 100.

The rapid-entry shoe 100 may comprises a plurality of elastic elements 110 on one side of the rapid-entry shoe 100 (e.g., 2, 3, 4 or more). That is, the rapid-entry shoe 100 may comprises a plurality of elastic elements 110 on one or both sides of the rapid-entry shoe 100. The plurality of elastic elements 110 may be separate from each other, and thus may have different (e.g., non-elastic) upper material separating the plurality of elastic elements 110.

As shown in FIG. 6H, each of the elastic elements 110 can comprise a longitudinal axis that substantially conforms to the shape of the curvature of the forward portion of the rapid-entry shoe 100.

FIGS. 6A-6C illustrate the rapid-entry shoes 100 of FIGS. 6I-6K, but with the addition of an elastic element extending on a lateral side portion extending from a top collar/topline opening of the rapid-entry shoe 100 completely (FIG. 6A) or partially FIGS. 6B and 6C to a sole portion of the rapid-entry shoe 100.

FIG. 6F illustrates the rapid-entry shoe 100 of FIG. 6B, but with the addition of a top fin 156 to the stabilizer 150.

As shown in FIG. 6D, the rapid-entry shoe 100 may comprises a plurality of stabilizers 150, for example, a first stabilizer 150 positioned forward and a second stabilizer 150 positioned rearward, both relative to the elastic element 110.

As shown in FIGS. 6E and 6G, the rapid-entry shoe 100 may comprise a stabilizer 150, wherein the base portion 152 extends into and/or is coupled to the sole portion of the rapid entry-shoe 100.

In various embodiments, the stabilizer comprises two separate parts, a lateral portion on a lateral side portion and a medial portion on a medial side portion. The lateral and medial portions may be separate and independent from each other. In other embodiments, the stabilizer 150 is a single, unitary structure. In various embodiments, the stabilizer 150 comprises an arch structure such that the base portion 152 comprises a first end and a second end. The first end may be coupled to or may extend from a medial side portion of the sole portion of the rapid-entry shoe 100 and the second end may be coupled to or may extend from a lateral side portion of the sole portion of the rapid-entry shoe 100. Accordingly, the elevated portion 154 may extend between the two ends and around the rear portion of the rapid-entry shoe 100 above the sole portion. In various embodiments, the arch structure of the stabilizer 150 defines a window 159 (e.g., a void) at the rear portion.

In example embodiments, the upper of the rapid-entry shoe 100 and the stabilizer 150 are not moveable relative to each other, while in other embodiments, the upper of the rapid-entry shoe 100 and the stabilizer 150 are moveable relative to each other, while in other embodiments and such relative mobility may be located at or around, or otherwise enhanced by the presence of, the window 159.

In various embodiments, and with reference to FIG. 0.7A, the rapid-entry shoe 100 may include a resiliently deformable element 160 within a window 159 defined by the arch structure of the stabilizer 150, the resiliently deformable 160 element being configured to facilitate closure of the rapid-entry shoe after a user's foot has been fully inserted into the shoe, e.g., as described in U.S. Pat. No. 9,820,527, which is incorporated herein by reference for all purposes. In such embodiments, an upper edge of the resiliently deformable element 160 can be coupled to an upper edge of the window 159.

In various embodiments, and with reference to FIG. 0.7B, the rapid-entry shoe 100 may include a compressible lattice structure 170 within a window 159 defined by the arch structure of the stabilizer 150, the compressible lattice structure 170 being configured to facilitate closure of the rapid-entry shoe after a user's foot has been fully inserted into the shoe, e.g., as described in U.S. Pat. No. 10,638,810, which is incorporated herein by reference for all purposes. In such embodiments, an upper edge of the compressible lattice structure 170 can be coupled to an upper edge of the window 159.

In various embodiments, and with reference to FIGS. 8A-8D, the arch structure of the stabilizer 150 defines a window 159, and an expansion zone 175 may be disposed within the window 159. The expansion zone 175 can be comprised of an elastic or resiliently deformable material and/or portion of the upper. Expansion or deformation of the expansion zone 175 can enlarge the foot opening of the rapid-entry shoe 100, while contraction of the expansion zone 175 can reduce the foot opening of the rapid-entry shoe 100, according to various embodiments. That is, the expansion zone 175 can be configured to expand in a rearward direction and contract in a forward direction, according to various embodiments. FIGS. 8A-8D illustrate a rapid-entry shoe having an expansion zone and progressive stages of a foot being inserted into the rapid-entry shoe, in accordance with an example embodiment.

In various embodiments, and with reference to FIGS. 9A-9D, the arch structure of the stabilizer 150 defines a window 159, and a deflectable element 180 may be disposed within the window 159.

In example embodiments, the stabilizer 150 is disposed about a rear portion of the rapid-entry shoe 100 and extends (from, or from below, and) above a sole portion of the rapid-entry shoe 100. Similar to above, the stabilizer may include a base portion 152 and an elevated portion 154. In various embodiments, the deflectable element 180 is disposed below the elevated portion 154 of the stabilizer 150 and within the window 159, and is rotatably/deflectably coupled to the stabilizer 150 (e.g., at the elevated portion 154). For example, the deflectable element 180 may be a separate part that is hingedly coupled or pivotably coupled to the stabilizer 150. In various embodiments, the deflectable element 180 may extend from the stabilizer 150 via a living hinge. That is, the junction between the deflectable element 180 and the stabilizer 150 may comprise a scored portion or a narrowed portion to enable flexure of the deflectable element 180 relative to the stabilizer 150. Rearward rotation of the deflectable element 180 enlarges a foot opening of the rapid-entry shoe 100, while forward rotation of the deflectable element 180 reduces a foot opening of the rapid-entry shoe 100.

The deflectable element 180 can be comprised of a stiff, rigid or semi-rigid material. In response to a foot being inserted into the foot opening of the rapid-entry shoe 100, the deflectable element 180 may rotate/deflect outward (i.e., rearward, away from its closed position) in order to accommodate a foot during insertion. The deflectable element 180 may be spring-loaded (e.g., using one or more torsion springs) or may otherwise have its rotating/deflecting movement biased (e.g., using one or more compression springs) to move the deflectable element 180 back to its closed position after a foot has been fully inserted into the foot opening of the rapid-entry shoe 100.

The deflectable element 180 can be configured to partially or completely fill the window 159. When in its closed position, the outermost surface of the deflectable element 180 can be coplanar with the outermost surface of the window 159. In example embodiments, the intersection of the deflectable element 180 and the window 159 has some overlap (e.g., the edges of the deflectable element 180 and the window 159 are complimentarily angled or curved). In example embodiments, the intersection of the deflectable element 180 and the window 159 is configured to prevent upward movement of the deflectable element 180 relative to the window 159.

Optionally, the rapid-entry shoe 100 may further include an elastic band 185 coupled to or extending around the deflectable element 180 such that elastic band 185 biases the deflectable element 180 forward, back to its closed position. The elastic band 185 can be comprised of an elastic or resiliently deformable material and/or portion of the upper.

FIGS. 9A-9D illustrate a rapid-entry shoe having a deflectable element and progressive stages of a foot being inserted into the rapid-entry shoe, in accordance with an example embodiment.

Figure 10A:
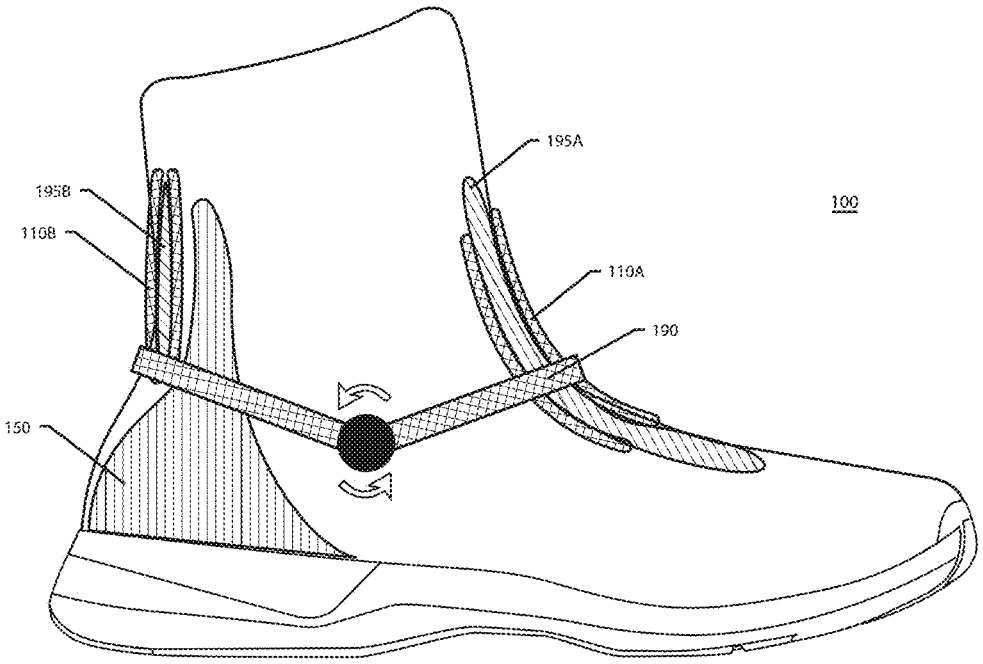
FIGS. 10A and 10B illustrate rapid-entry shoes, each having forward and rear elastic elements and a connector arm, in accordance with an example embodiment.
Figure 10B:
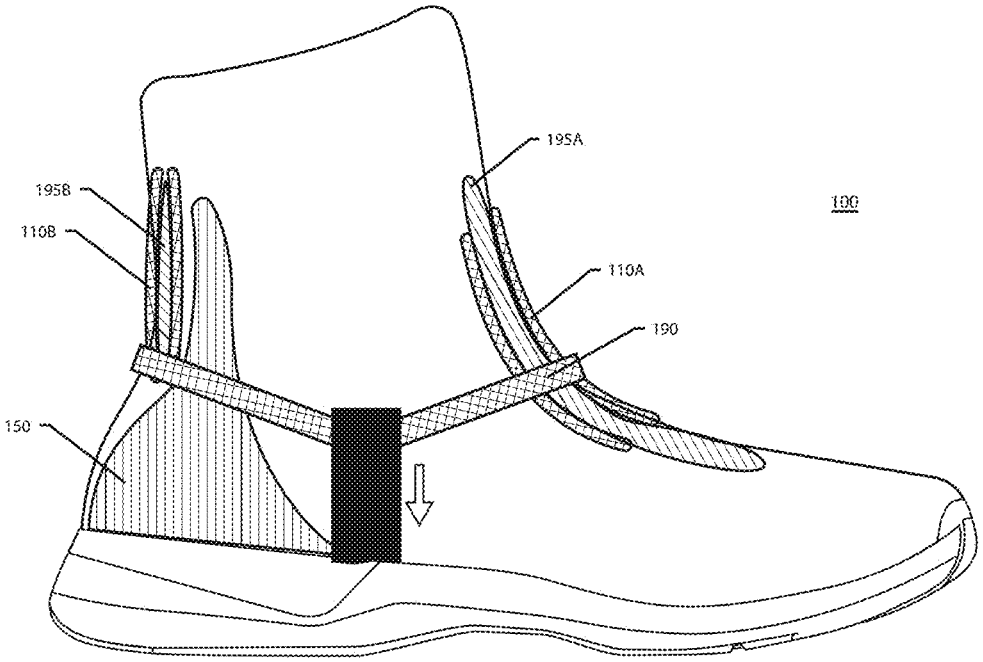

In various embodiments, and with reference to FIGS. 10A and 10B, a rapid-entry shoe 100 comprises a forward elastic element 110A and a rear elastic element 110B. The rear elastic element 110B is disposed on a rear side of the rapid-entry shoe 100 above a sole portion, and the forward elastic element 110A is disposed on a forward side of the rapid-entry shoe 100 above a sole portion, according to various embodiments.

In various embodiments, a rapid-entry shoe 100 further comprises one or more semi-rigid inserts 195A, 195B that are configured to support the elastic elements 110A, 110B. In various embodiments, the semi-rigid inserts 195A, 195B are decreasingly rigid (whether due to dimension, orientation and/or material) higher in the upper to provide more flex and are increasingly rigid lower in the upper to provide more support. In various embodiments, the semi-rigid inserts 195A, 195B are further configured to move between and/or along the elastic elements 110A, 110B. The semi-rigid inserts 195A, 195B may be coupled to the upper and/or the elastic elements 110A, 110B.

In various embodiments, the rapid-entry shoe 100 may combine one or more features previously described. For example, the forward elastic element 110A may be similar to the elastic element 110 described above. Similarly, the rear elastic element 110B may be similar to the elastic element 110 described above but placed on the rear portion of the shoe 100.

The rapid-entry shoe 100 may further comprise a connector arm 190 extending along one or both of a lateral side portion and a medial side portion of the rapid-entry shoe 100 between the rear elastic element 110B and the forward elastic element 110A. Forward expansion of the forward elastic 110A section and/or rearward expansion of the rear elastic element 110B enlarges a foot opening of the rapid-entry shoe 100, and corresponding contraction of the forward elastic element 110A and the rear elastic element 110B reduces a foot opening of the rapid-entry shoe 100.

The connector arm 190 may be a strap or other retention feature that runs along a side of the rapid-entry shoe 100 between the elastic elements. In various embodiments, a rapid-entry shoe 100 may comprise connector arms 190 on both sides of the rapid-entry shoe 100. The connector arm 190 can be comprised of an elastic or resiliently deformable material and/or portion of the upper. Alternatively, the connector arm 190 can be comprised of a stiff, rigid or semi-rigid material.

The connector arm 190 may have a forward segment and a rear segment, with a central coupling disposed between the forward segment and the rear segment. With particular reference to FIG. 10A, the central coupling may be configured to exert a rotational bias on the forward and/or rear segments of the connector arm 190, thereby biasing the elastic elements 110A and 110B together to retain the rapid-entry shoe 100 about the user's foot. In this regard, the forward segment and the rear segment may be configured to at least partially rotate about the central coupling relative to each other. Alternatively, and with particular reference to FIG. 10B, the central coupling may be configured to exert a downward bias on the forward and/or rear segments of the connector arm 190, thereby biasing the elastic elements 110A and 110B together to retain the rapid-entry shoe 100 about the user's foot.

In example embodiments, the central coupling is configured to concentrate elastic properties of the front and rear connector arms such that the forces of the elongation of the front and rear of the rapid-entry shoe 100 are applied simultaneously. Alternatively, the central coupling is configured to concentrate elastic properties of the front and rear connector arms such that the forces of the elongation of the front and rear of the rapid-entry shoe 100 are applied sequentially.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe comprising:

a sole portion and an upper, the upper comprising a rear portion, a forward portion, and a side portion, the side portion extending between the rear portion and the forward portion;

an elastic element disposed at the side portion, the elastic element extending to and forming a portion of a topline of the rapid-entry shoe, and the elastic element further extending to the sole portion;

a stabilizer disposed at the rear portion and extending from within the sole portion, the stabilizer comprising a base portion at least partially within the sole portion and an elevated portion;

wherein the base portion of the stabilizer defines a closed cup portion extending completely between lateral and medial sides of the sole portion;

wherein the stabilizer comprises a curvature between its lateral and medial sides, and wherein, from the base portion toward the elevated portion, the curvature extends progressively less between its lateral and medial sides;

wherein the elevated portion of the stabilizer comprises a flare portion extending rearward to direct a foot into a foot opening of the rapid-entry shoe;

wherein expansion or deformation of the elastic element enlarges the foot opening of the rapid-entry shoe, and wherein contraction of the elastic element reduces the foot opening of the rapid-entry shoe;

wherein the stabilizer is comprised of a rigid material such that the rear portion of the upper at which the stabilizer is disposed is configured to resist downward collapse;

wherein the rapid-entry shoe comprises a foam liner oriented concave toward the sole portion; and wherein the elastic element is configured to enable the forward portion of the rapid-entry shoe to flex and/or pivot forward relative to the sole portion.

2. The rapid-entry shoe of claim 1, wherein the stabilizer comprises a rigid fin coupled to the elevated portion of the stabilizer, the rigid fin being configured to be vertically stable and laterally mobile relative to the elevated portion of the stabilizer.

3. The rapid-entry shoe of claim 2, wherein a concave portion of the rigid fin is coupled to a convex portion of the elevated portion of the stabilizer.

4. A rapid-entry shoe comprising:

a sole portion and an upper, the upper comprising a rear portion, a side portion, and a forward portion;

an elastic element disposed at the side portion, the elastic element extending to and forming a portion of a topline of the rapid-entry shoe, and the elastic element not extending to the sole portion;

a stabilizer disposed at the rear portion and extending from within the sole portion, the stabilizer comprising a base portion at least partially within the sole portion and an elevated portion;

wherein the stabilizer comprises an arch structure such that the base portion of the stabilizer comprises a first end and a second end, the first end coupled to or extending from a medial side of the sole portion of the rapid-entry shoe and the second end coupled to or extending from a lateral side of the sole portion of the rapid-entry shoe, wherein the elevated portion of the stabilizer extends between the first end and the second end and around the rear portion of the rapid-entry shoe, and wherein the elevated portion of the stabilizer and the base portion of the stabilizer together define a window positioned above the sole portion;

wherein the stabilizer further comprises an expansion zone positioned exclusively within the window, the expansion zone coupled to the elevated portion of the stabilizer;

wherein expansion or deformation of the elastic element enlarges a foot opening of the rapid-entry shoe, and wherein contraction of the elastic element reduces the foot opening of the rapid-entry shoe; and wherein the stabilizer is comprised of a rigid material such that the rear portion of the upper at which the stabilizer is disposed is configured to resist downward collapse.

5. The rapid-entry shoe of claim 4, wherein the stabilizer comprises a rigid fin coupled to the elevated portion of the stabilizer, the rigid fin being configured to be vertically stable and laterally mobile relative to the elevated portion of the stabilizer.

6. The rapid-entry shoe of claim 5, wherein a concave portion of the rigid fin is coupled to a convex portion of the elevated portion of the stabilizer.

* * * * *